US010726771B2

(12) United States Patent
Zhou

(10) Patent No.: US 10,726,771 B2
(45) Date of Patent: Jul. 28, 2020

(54) PIXEL CIRCUIT, DRIVING METHOD AND DISPLAY DEVICE

(71) Applicant: EverDisplay Optronics (Shanghai) Limited, Shanghai (CN)

(72) Inventor: Xingyu Zhou, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 0 days.

(21) Appl. No.: 15/986,711

(22) Filed: May 22, 2018

(65) Prior Publication Data

US 2018/0342199 A1 Nov. 29, 2018

(30) Foreign Application Priority Data

May 23, 2017 (CN) ..... 2017 1 0370528

(51) Int. Cl.
*G09G 3/30* (2006.01)
*G09G 3/32* (2016.01)

(52) U.S. Cl.
CPC ..... *G09G 3/32* (2013.01); *G09G 2300/0814* (2013.01); *G09G 2300/0819* (2013.01); *G09G 2320/0233* (2013.01); *G09G 2320/045* (2013.01)

(58) Field of Classification Search
CPC .... G09G 3/30–3291; G09G 2300/0439–0465; G09G 2300/0809–0871; G09G 2320/0233; G09G 2320/045
USPC ..... 345/76–83, 694
See application file for complete search history.

(56) References Cited

U.S. PATENT DOCUMENTS

2006/0055336 A1* 3/2006 Jeong ..... G09G 3/3233 315/169.3
2006/0170634 A1* 8/2006 Kwak ..... G09G 3/3233 345/92
2015/0255523 A1* 9/2015 Her ..... H01L 27/3262 345/76
2016/0035282 A1* 2/2016 Lu ..... H05B 33/0896 315/291
2016/0063943 A1* 3/2016 Lee ..... G09G 5/18 345/211
2016/0217746 A1* 7/2016 An ..... G09G 3/3233

FOREIGN PATENT DOCUMENTS

CN 1361510 A 7/2002
CN 1874627 A 12/2006
CN 101231821 A 7/2008
CN 102290027 A 12/2011
(Continued)

OTHER PUBLICATIONS

1st Office Action dated Jan. 26, 2018 by the SIPO.
The Decision of Rejection dated Oct. 23, 2019 by the CNIPA.

*Primary Examiner* — Amr A Awad
*Assistant Examiner* — Aaron Midkiff
(74) *Attorney, Agent, or Firm* — Yunling Ren

(57) ABSTRACT

A pixel circuit, a driving method and a display device having the pixel circuit are disclosed, wherein the pixel circuit comprises a compensation unit, a driving unit, a light emitting unit, a capacitor, an initialization unit and an external power supply and the driving method comprises a first initialization stage, a second initialization stage, a data writing stage and a light emitting stage.

14 Claims, 14 Drawing Sheets

(56) References Cited

FOREIGN PATENT DOCUMENTS

| | | | | |
|---|---|---|---|---|
| CN | 205004019 | U | | 1/2016 |
| CN | 105989805 | A | | 10/2016 |
| KR | 20050049686 | A | * | 5/2005 |
| KR | 100543013 | B1 | | 1/2006 |

* cited by examiner

PIXEL CIRCUIT, DRIVING METHOD AND DISPLAY DEVICE

CROSS REFERENCE TO RELATED APPLICATIONS

This application is based upon and claims the benefit of priority of Chinese Patent Applications No. 201710370528.1 filed on May 23, 2017, the entire contents thereof are incorporated herein by reference.

TECHNICAL FIELD

One disclosed embodiment relates to an electric display device. More particularly, one disclosed embodiment relates to a pixel circuit, a method for driving the pixel circuit and a display device having the pixel circuit.

BACKGROUND

Currently, a light emitting diode (LED) of a pixel circuit is usually driven by a thin-film transistor (TFT), which may be mentioned as a driving transistor, in a pixel circuit. The driving transistor operates in saturation region to provide a more stable driving current for the LED, since a saturated driving transistor outputs a driving current less sensitive to the source-drain voltage than that output by a driving transistor operating in linear region. FIG. 1 is a schematic diagram of an existing basic pixel circuit. As shown in FIG. 1, the pixel circuit comprises transistors T1 and T12 and a capacitor C11. When the transistor T11 conducts in response to a signal Sn, a data signal data which charges the capacitor C11 and turns on the transistor T1 is input through a node N1. The driving current generated by the transistor T11 drives an LED EL11, between a first power supply ELVDD and a second power supply ELVSS, to emit light. The magnitude of the driving current can be calculated with Equation 1 below.

$$I_{EL} = \frac{1}{2}\mu C_{OX}\frac{W}{L}(V_{GS} + V_{TH})^2 \quad \text{(Equation 1)}$$

The μ refers to the mobility of carrier. The $C_{ox}$ refers to the gate oxide capacitance per unit area of the transistor T11. The L refers to the channel length of the transistor T11, and the W refers to the gate width of the transistor T11. The $V_{GS}$ refers to the gate-to-source voltage of the transistor T11, and the $V_{TH}$ refers to the threshold voltage of the transistor T11. However, a threshold voltage drift may cause the threshold voltage of the transistor T11 to be unstable, thus the driving current may drift, leading to the illumination of the LED unstable.

Hence, various circuits, mentioned as threshold compensation circuits, have been developed to eliminate the adverse effect of the threshold voltage drift of the driving transistor. FIG. 2 is a schematic diagram of an existing threshold compensation circuit. Transistors T22 and T23 are turned on in response to the signal Sn to short-circuit a gate electrode and a drain electrode of a driving transistor T21 in a data writing stage. Meanwhile, a transistor T25 is turned off by a signal En, and a transistor T24 is turned off by a signal Sn−1. The data signal data is input by the source electrode of the transistor T21 through the transistor T22. Since the gate and drain electrodes of the transistor T21 are short-circuited, the data signal is input by the gate electrode, charging the capacitor C21, through the drain electrode of the transistor T21. The capacitor continues to be charged until the voltage on the gate electrode of the transistor T22 decreases to ($V_{data}$+$V_{TH}$) and the transistor T21 is turned off. In a light emitting stage, the transistor T25 is turned on by the signal En, the transistor T24 turned off by the signal Sn−1, and the transistors T22 and T23 turned off by the signal Sn. The power supply ELVDD is provided to the transistor T21 through the transistor T25, while the magnitude of the driving current generated by the driving transistor can be calculated with Equation 2 below.

$$I_{EL} = \frac{1}{2}\mu C_{OX}\frac{W}{L}(V_{ELVDD} - V_{data})^2 \quad \text{(Equation 2)}$$

As shown above in Equation 2, the magnitude of the driving current no longer relates to the threshold voltage of the driving transistor T21.

However, an existing threshold compensation circuit, such as the one shown in FIG. 2, has only a single transistor T25 between the power supply ELVDD and the data signal. With the data signal easily affected by the power supply, it is hard to stabilize the light emitting of the LED, since the voltage of the power supply ELVDD is much higher than that of other signals and a leakage current of T25 exists.

Moreover, a pixel circuit, referring to FIG. 2, in existing technology is usually configured to initialize the voltage on the node N2, wherein the voltage mentioned is also the voltage on the gate electrode of the driving transistor T21. Some existing pixel circuits are further configured to initialize the anode of the LED as well. Speaking of a pixel circuit only configured to initialize the gate electrode of the driving transistor, the light emitting of the LED, not initialized, can be unstable. As for a pixel circuit configured to initialize both the gate electrode of the driving transistor and the anode of the LED, the safety of the circuit is insufficient.

To summarize, a situation where the light emitting of an LED is unstable and the safety of the circuit is insufficient exists.

SUMMARY

The present disclosure provides a pixel circuit, a method for driving the pixel circuit and a display device which can stable the light emitting of LEDs and enhance safety of pixel circuits.

In one embodiment, a pixel circuit is disclosed. The pixel circuit comprises a compensation unit, a driving unit, a light emitting unit, a capacitor, an initialization unit and an external power supply, wherein the compensation unit is electrically coupled to the driving unit via a first node; wherein the external power supply, the driving unit and the light emitting unit are sequentially coupled in series; wherein the capacitor is disposed between the first node and the external power supply; wherein the initialization unit is disposed between the first node and the light emitting unit; wherein the compensation unit is configured to receive an external data signal and an external first scanning signal; wherein the compensation unit is configured to set a voltage on the first node to a first voltage in response to the first scanning signal; wherein the first voltage includes a voltage having a compensation voltage, generated by a compensation transistor in the compensation unit, and the voltage of the data signal; wherein the capacitor is configured to hold the voltage on the first node at the first voltage; wherein the driving unit is configured to receive an external first control signal; wherein the driving unit is configured to generate a driving current, in response to the first control signal, to drive the light emitting unit to emit light; wherein the driving current is generated in response to the first voltage, the external power supply and a threshold voltage of a driving transistor of the driving unit; wherein a gate electrode of the driving transistor is coupled to a gate electrode of the compensation transistor; wherein the initialization unit is configured to receive an external second scanning signal, an external third scanning signal and an external initialization voltage; wherein the initialization unit is configured to initialize the first node, in response to the second scanning signal, with the initialization voltage and to initialize the light emitting unit, in response to the third scanning signal, with the initialization voltage.

In some embodiments, the threshold voltage of the driving transistor is equal to a threshold voltage of the compensation transistor.

In some embodiments, the third scanning signal includes the first scanning signal.

In some embodiments, the initialization unit comprises: a first initialization transistor having a first electrode configured to receive the initialization signal, a second electrode electrically coupled to the first node, and a gate electrode configured to receive the second scanning signal, and a second initialization transistor having a first electrode configured to receive the initialization signal, a second electrode electrically coupled to the light emitting unit, and a gate electrode configured to receive the third scanning signal.

In some embodiments, the compensation unit comprises: a data strobe transistor having a first electrode electrically coupled to a second electrode of a compensation transistor, a second electrode configured to receive the external data signal, and a gate electrode configured to receive the external first scanning signal; wherein a gate electrode of the compensation transistor is electrically coupled to the driving unit via the first node and electrically coupled to a first electrode of the compensation transistor; wherein the compensation unit is configured to turn on the data strobe transistor in response to the first scanning signal, and the compensation transistor then set a voltage of the first node as a first voltage, wherein the first voltage includes the compensation voltage, generated by the compensation transistor of the compensation unit, and the voltage of the data signal.

In some embodiments, the compensation unit further comprises: a switch transistor having a first electrode electrically coupled to the gate electrode of the compensation transistor, a second electrode electrically coupled to the first electrode of the first electrode of the compensation transistor, and a gate electrode configured to receive the external first scanning signal and the switch transistor configured to conduct the compensation transistor in response to the first scanning signal.

In some embodiments, a method for driving a pixel circuit is disclosed. The steps of the method comprise:

a first initialization stage, including: turning on a second initialization transistor, configured to initialize a light emitting unit with an initialization voltage, by a third scanning signal; turning off a compensation unit by a first scanning signal; turning off a driving unit by a first control signal; and turning off a first initialization transistor by a second scanning signal;

a second initialization stage includes: turning on the first initialization transistor, configured to initialize the light emitting unit with the initialization voltage, by the second scanning signal; turning off the compensation unit by the first scanning signal; turning off the driving unit by the first control signal; and turning off the second initialization transistor by a third scanning signal;

a data writing stage includes: turning on the compensation unit, configured to set a voltage on a first node at a first voltage, by the first scanning signal; turning off the driving unit by the first control signal such that the light emitting unit does not emit light; turning off the first initialization transistor by the second scanning signal; and holding the voltage on the first node at the first voltage by a capacitor in a charging state, wherein the first voltage includes a voltage having a compensation voltage, generated by a compensation transistor in a compensation unit, and the voltage of the data signal;

and a light emitting stage includes: turning off the compensation unit by the first scanning signal; turning off the first initialization transistor by the second scanning signal; turning off the second initialization transistor by the third scanning signal; and turning on the driving unit, configured to generate a driving current which corresponds to the first voltage, an external power supply and a threshold voltage of a driving transistor in the driving unit, to drive the light emitting unit to emit light, by the first control signal, wherein the capacitor is configured to be in a holding state.

In some embodiments, the third scanning signal includes the first scanning signal and the first initialization stage is incorporated in the data writing stage.

In some embodiments, the step of turning on the compensation unit by the first scanning signal comprises turning on a data strobe transistor by the first scanning signal.

In some embodiments, the step of turning on the compensation unit by the first scanning signal comprises turning on a switch transistor by the first scanning signal.

In some embodiments, a display device comprising a pixel circuit is disclosed, wherein the pixel circuit includes: a compensation unit, a driving unit, a light emitting unit, a capacitor, an initialization unit and an external power supply, wherein the compensation unit is electrically coupled to the driving unit via a first node; wherein the external power supply, the driving unit and the light emitting unit are sequentially coupled in series; wherein the capacitor is disposed between the first node and the external power supply; wherein the initialization unit is disposed between the first node and the light emitting unit; wherein the compensation unit is configured to receive an external data signal and an external first scanning signal; wherein the compensation unit is configured to set a voltage on the first node to a first voltage in response to the first scanning signal; wherein the first voltage includes a voltage having a compensation voltage, generated by a compensation transistor in the compensation unit, and the voltage of the data signal; wherein the capacitor is configured to hold the voltage on the first node at the first voltage; wherein the driving unit is configured to receive an external first control signal; wherein the driving unit is configured to generate a driving current, in response to the first control signal to drive the light emitting unit to emit light; wherein the driving current is generated in response to the first voltage, the external power supply and a threshold voltage of a driving transistor of the driving unit; wherein a gate electrode of the driving transistor is coupled to a gate electrode of the compensation transistor; wherein the initialization unit is configured to receive an external second scanning signal, an external third scanning signal and an external initialization voltage; wherein the initialization unit is configured to initialize the first node, in response to the second scanning signal, with the initialization voltage and to initialize the light emitting unit, in response to the third scanning signal, with the initialization voltage.

In some embodiments, the threshold voltage of the driving transistor is equal to a threshold voltage of the compensation transistor.

In some embodiments, the third scanning signal includes the first scanning signal.

In some embodiments, the initialization unit comprises: a first initialization transistor having a first electrode configured to receive the initialization signal, a second electrode electrically coupled to the first node, and a gate electrode configured to receive the second scanning signal, and a second initialization transistor having a first electrode configured to receive the initialization signal, a second electrode electrically coupled to the light emitting unit, and a gate electrode configured to receive the third scanning signal.

In some embodiments, the compensation unit comprises: a data strobe transistor having a first electrode electrically coupled to a second electrode of a compensation transistor, a second electrode configured to receive the external data signal, and a gate electrode configured to receive the external first scanning signal; wherein a gate electrode of the compensation transistor is electrically coupled to the driving unit via the first node and electrically coupled to a first electrode of the compensation transistor; wherein the compensation unit is configured to turn on the data strobe transistor in response to the first scanning signal, and the compensation transistor then set a voltage of the first node as a first voltage, wherein the first voltage includes the compensation voltage, generated by the compensation transistor of the compensation unit, and the voltage of the data signal.

In some embodiments, the compensation unit further comprises: a switch transistor having a first electrode electrically coupled to the gate electrode of the compensation transistor, a second electrode electrically coupled to the first electrode of the first electrode of the compensation transistor, and a gate electrode configured to receive the external first scanning signal and the switch transistor configured to conduct the compensation transistor in response to the first scanning signal.

In summary, a pixel circuit, a method for driving the pixel circuit and a display device having the pixel circuit are provided by some embodiments of current disclosure. In some embodiments, the pixel circuit comprises a compensation unit, a driving unit, a light emitting unit, a capacitor, an initialization unit and an external power supply, wherein the compensation unit is electrically coupled to the driving unit via a first node; wherein the external power supply, the driving unit and the light emitting unit are sequentially coupled in series; wherein the capacitor is disposed between the first node and the external power supply; wherein the initialization unit is disposed between the first node and the light emitting unit; wherein the compensation unit is configured to receive an external data signal and an external first scanning signal, wherein the compensation unit is configured to set a voltage on the first node to a first voltage in response to the first scanning signal; wherein the first voltage includes a voltage having a compensation voltage, generated by a compensation transistor in the compensation unit, and the voltage of the data signal; wherein the capacitor is configured to hold the voltage on the first node at the first voltage; wherein the driving unit is configured to receive an external first control signal; wherein the driving unit is configured to generate a driving current, in response to the first control signal, to drive the light emitting unit to emit light; wherein the driving current is generated in response to the first voltage, the external power supply and a threshold voltage of a driving transistor of the driving unit; wherein a gate electrode of the driving transistor is coupled to a gate electrode of the compensation transistor; wherein the initialization unit is configured to receive an external second scanning signal, an external third scanning signal and an external initialization voltage; wherein the initialization unit is configured to initialize the first node, in response to the second scanning signal, with the initialization voltage and to initialize the light emitting unit, in response to the third scanning signal, with the initialization voltage. The compensation unit receives an external data signal and the driving unit is coupled to an external power supply, such that the data signal can be compensated in a data writing stage by the compensation transistor of the compensation unit, wherein a first voltage includes a voltage having a compensation voltage, generated by the compensation transistor in the compensation unit, and the voltage of the data signal. The adverse effect of the external power supply, to which the compensation unit is not coupled, to the data signal can be avoided. Furthermore, the voltage on the gate electrode of the driving transistor is equal to that on the gate electrode of the compensation transistor with the gate electrodes coupled to each other, and compensating the voltage of the data signal with the threshold voltage of the compensation transistor is comparable to compensating the voltage of the data signal with the threshold voltage of the driving transistor, such that the threshold compensation of the pixel circuit is ensured. Therefore, certain embodiments of present disclosure may both provide threshold compensation of the pixel circuit and avoid the external power supply from adversely affecting the data signal and the stability of the light emitting of the LED. What's more, with the initialization unit initializing the first node with the initialization voltage in response to the third scanning signal, it can be avoided that the first node and the light emitting unit are initialized at the same time, causing an instantaneous current, in response to the initialization voltage, which is sufficient to damage the pixel circuit, or its power supply, can be prevented, improving the safety of the pixel circuit.

BRIEF DESCRIPTION OF THE DRAWINGS

Those skilled in the art will readily appreciate that the detailed description with respect to these figures is for explanatory purposes only and should not be construed as limiting.

DETAILED DESCRIPTION

Those skilled in the art will readily appreciate that the detailed description given herein with respect to these figures is for explanatory purposes only and should not be construed as limiting.

In some embodiments, a pixel circuit is disclosed. The pixel circuit comprises a compensation unit, a driving unit, a light emitting unit, a capacitor, an initialization unit and an external power supply, wherein the compensation unit is electrically coupled to the driving unit via a first node; wherein the external power supply, the driving unit and the light emitting unit are sequentially coupled in series; wherein the capacitor is disposed between the first node and the external power supply; wherein the initialization unit is disposed between the first node and the light emitting unit; wherein the compensation unit is configured to receive an external data signal and an external first scanning signal; wherein the compensation unit is configured to set a voltage on the first node to a first voltage in response to the first scanning signal; wherein the first voltage includes a voltage having a compensation voltage, generated by a compensation transistor in the compensation unit, and the voltage of the data signal; wherein the capacitor is configured to hold the voltage on the first node at the first voltage; wherein the driving unit is configured to receive an external first control signal; wherein the driving unit is configured to generate a driving current, in response to the first control signal, to drive the light emitting unit to emit light; wherein the driving current is generated in response to the first voltage, the external power supply and a threshold voltage of a driving transistor of the driving unit; wherein a gate electrode of the driving transistor is coupled to a gate electrode of the compensation transistor; wherein the initialization unit is configured to receive an external second scanning signal, an external third scanning signal and an external initialization voltage; wherein the initialization unit is configured to initialize the first node, in response to the second scanning signal, with the initialization voltage and to initialize the light emitting unit, in response to the third scanning signal, with the initialization voltage.

Figure 1:
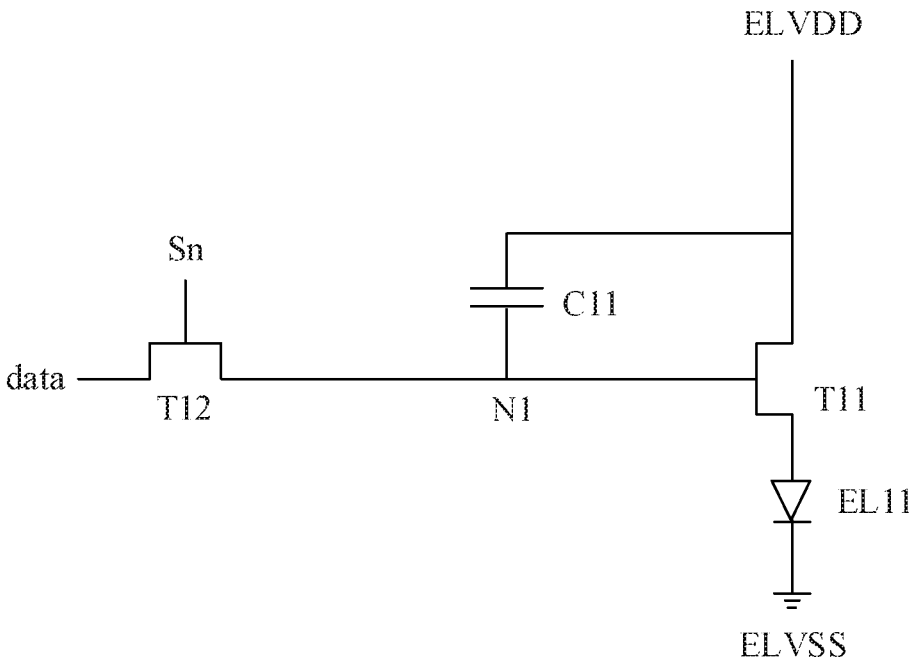
Fig. 1 (Prior Art)
FIG. 1 is a schematic diagram of an existing most basic pixel circuit.
Figure 2:
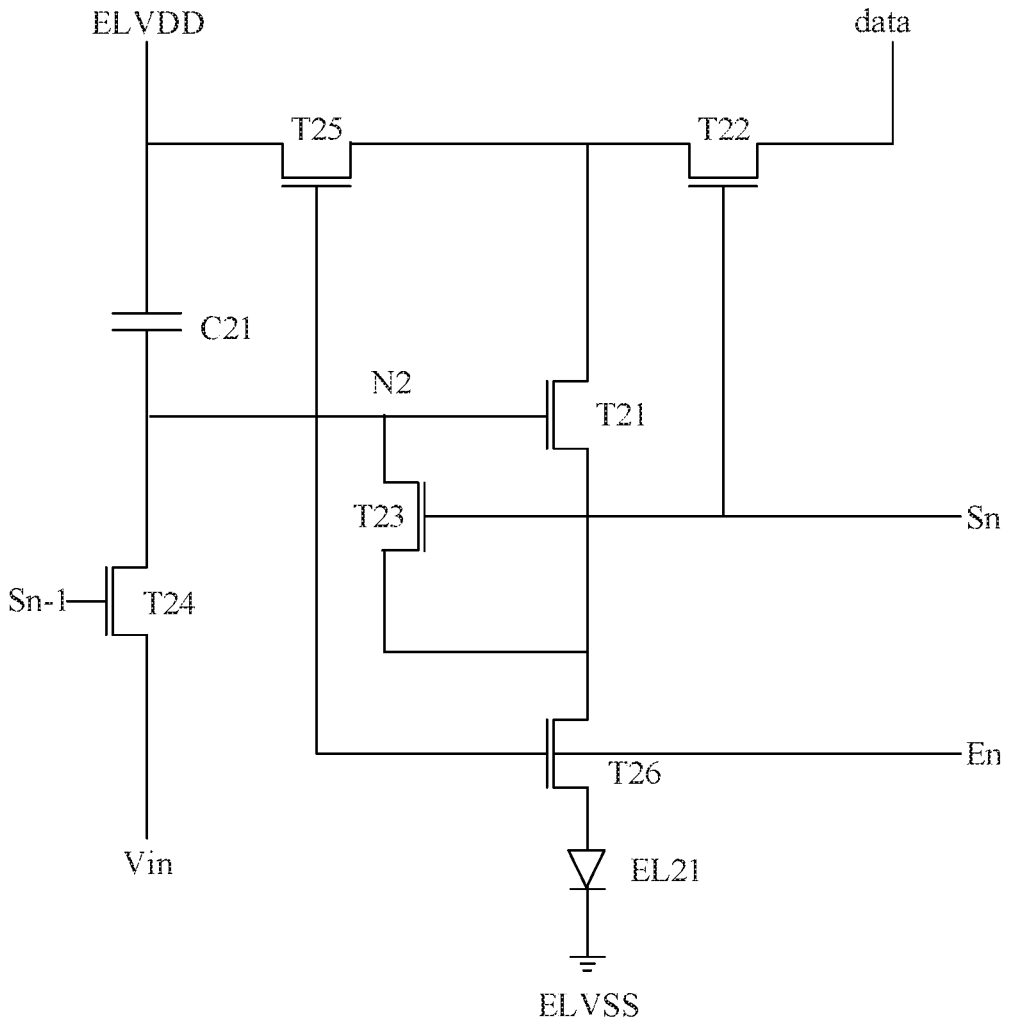
Fig. 2 (Prior Art)
FIG. 2 is a schematic diagram of an existing threshold compensation circuit.
Figure 3:
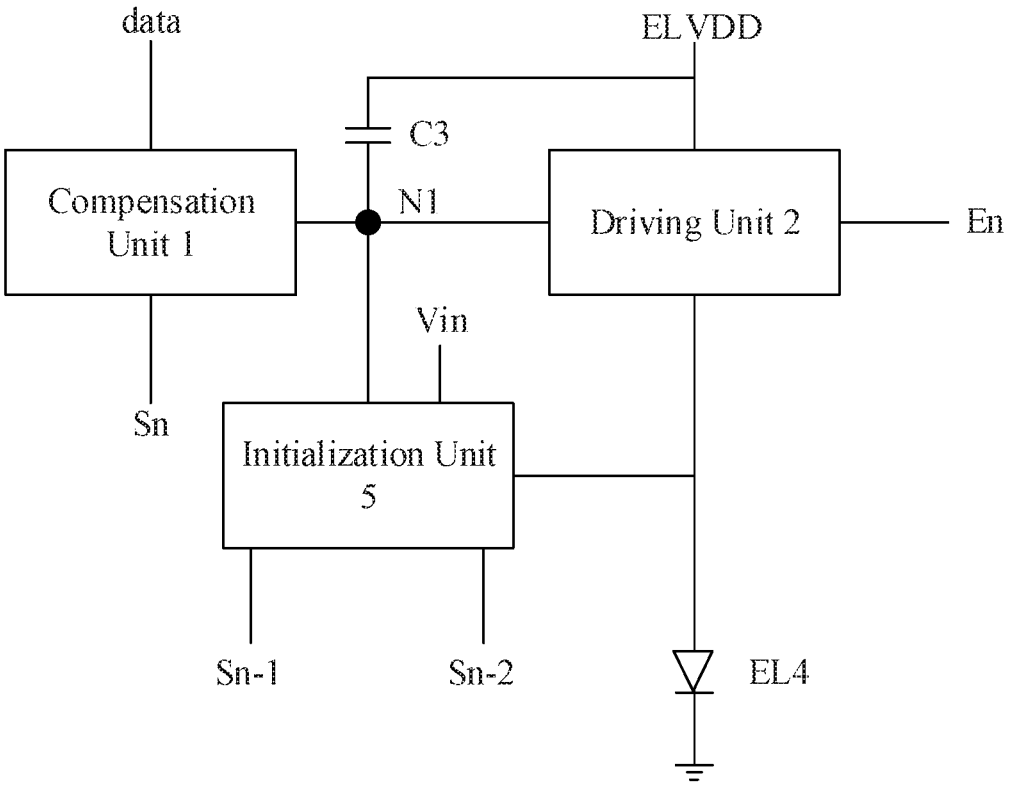
FIG. 3 is a block diagram of a pixel circuit in some exemplary embodiments.

FIG. 3 is a block diagram of a pixel circuit in some exemplary embodiments. The pixel circuit, as shown in FIG. 3, includes: a compensation unit 1, a driving unit 2, a light emitting unit EL4, a capacitor C3 and an external power supply ELVDD, wherein the compensation unit 1 is electrically coupled to the driving unit 2. The external power supply ELVDD, the driving unit 2 and the light emitting unit EL4 are sequentially coupled in series. The capacitor C3 is disposed between the first node N1 and the external power supply ELVDD. The initialization unit 5 is disposed between the first node N1 and the light emitting unit EL4. The compensation unit 1 is configured to receive an external data signal data and an external first scanning signal Sn. When the compensation unit 1 conducts in response to the first scanning signal Sn, the compensation unit 1 is configured to receive the data signal data and set a voltage on the first node N1 to a first voltage ($V_{data}+V_{thT1}$) wherein the voltage $V_{thT1}$ refers to a threshold voltage of the transistor T1. The capacitor C3 is configured to hold the voltage on the first node N1 at the first voltage. The driving unit 2 is configured to receive an external first control signal En, and to generate a driving current to drive the light emitting unit EL4 to emit light when the first control signal En turns the driving unit on. Herein, the driving current is generated in response to the first voltage, the external power supply ELVDD and a threshold voltage of a driving transistor of the driving unit 2. The magnitude of the driving current $I_{EL4}$ through the light emitting unit EL4, while the driving unit 2 is on, can be calculated with Equation 3 below, which comes from Equation 1.

$$I_{EL4} = \frac{1}{2}\mu C_{OX}\frac{W}{L}(V_{ELVDD} - V_{N1} + V_{thT2})^2 \quad \text{(Equation 3)}$$

As for Equation 3, the $V_{ELVDD}$ refers to a voltage of the external power supply ELVDD, with the $V_{N1}$ referring to the first voltage and the $V_{thT2}$ referring to the threshold voltage of the driving transistor. Since gate electrodes of the driving transistor and the compensation transistor are electrically coupled, the variation trend of the threshold voltage of the driving transistor is the same as that of the threshold voltage of the compensation transistor T1, which means that $V_{thT1}-V_{thT2}=A$, wherein the A is a constant. Therefore Equation 3 can be transformed into:

$$I_{EL} = \frac{1}{2}\mu C_{OX}\frac{W}{L}(V_{ELVDD} - V_{data} - A)^2 \quad \text{(Equation 4)}$$

Thus, the influence of a threshold current of the driving transistor on the LED can be eliminated. Moreover, the initialization unit 5 is configured to receive an external second scanning signal Sn−1, an external third scanning signal Sn−2 and an external initialization voltage Vin. The initialization unit 5 initializes the first node N1 with the initialization voltage Vin when turned on in response to the second scanning signal Sn−1, and initializes the light emitting unit EL4 with the initialization voltage Vin when turned on in response to the third scanning signal Sn−2. In this way, instead of initializing the first node N1 and the light emitting unit EL4 at the same time and the initialization voltage causing an instantaneous current large enough to damage the pixel circuit or its power supply, the initialization unit 5 initializes the first node N1 and the light emitting unit EL4 during different periods of time respectively, which improves the safety of the pixel circuit.

Optionally, the driving transistor and the compensation transistor form mirror transistors. In other words, the threshold voltages of the two transistors are the same, which means $V_{thT1}=V_{thT2}$. Equation 4 can be further simplified into Equation 2.

Figure 4:
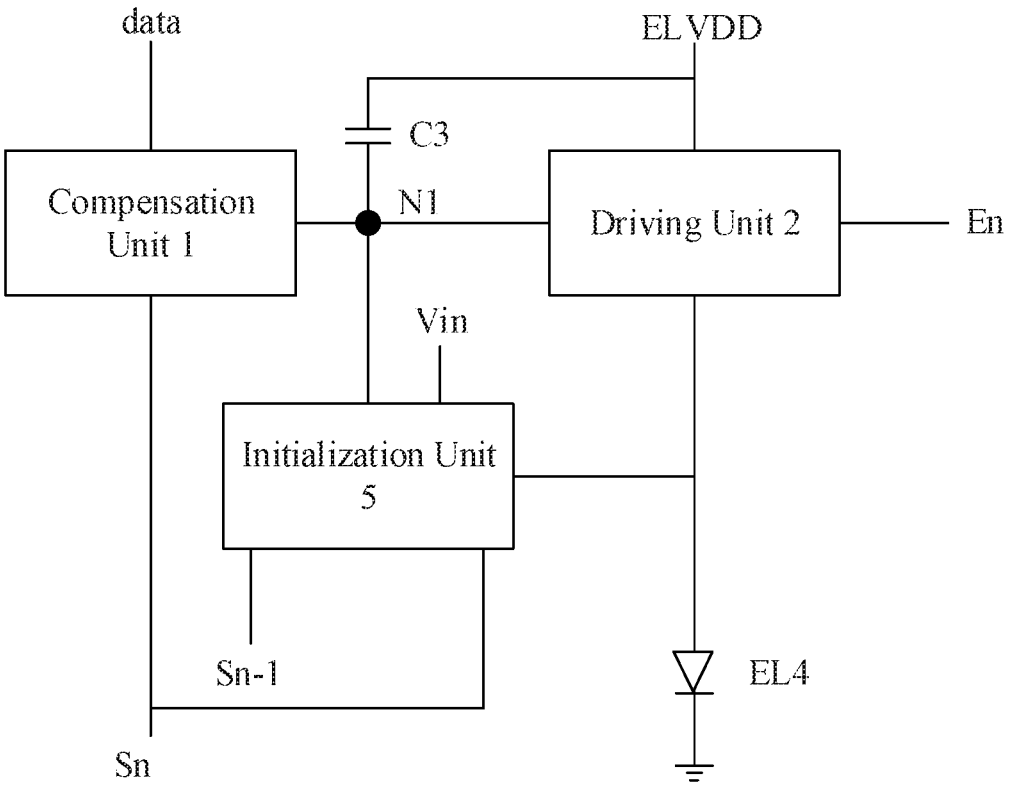
FIG. 4 is a block diagram of another pixel circuit in some exemplary embodiments.

Optionally, the third scanning signal includes the first scanning signal Sn. Referring to FIG. 4, which is a block diagram of another pixel circuit in some exemplary embodiments, the initialization unit 5 is configured to receive the external first scanning signal Sn, the external second scanning signal Sn−1 and the initialization voltage Vin. The initialization unit 5 initializes the first node N1 with the initialization voltage Vin when turned on in response to the second scanning signal, and initializes the light emitting unit EL4 with the initialization voltage Vin in response to the first scanning signal Sn. It can be ensured, using the first scanning signal Sn as the third scanning signal, that the initialization unit 5 initializes the first node N1 and the light emitting unit EL4 during different periods of time. Moreover, an external scanning signal can be omitted such that the circuit can be simplified.

Figure 5:
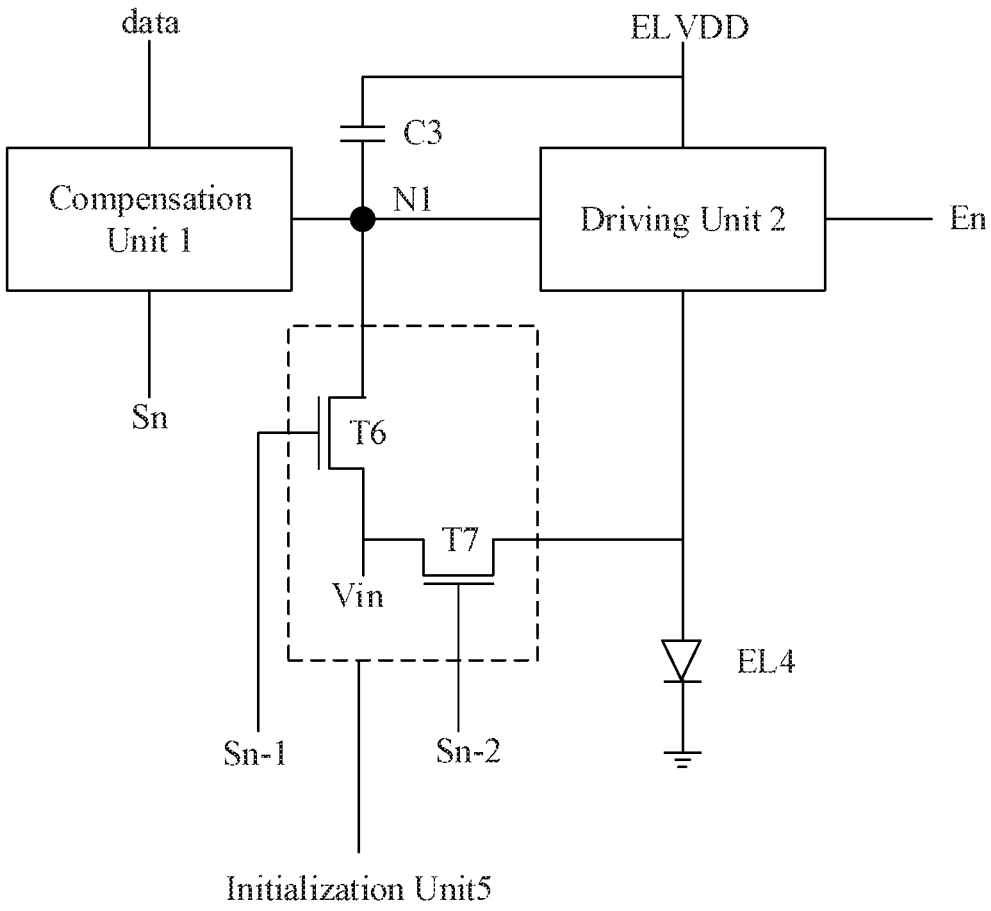
FIG. 5 is a block diagram schematically illustrating the structure of an initialization unit in some exemplary embodiments.

Some exemplary embodiments of present disclosure provide the implementation of an initialization unit, based on any of the pixel circuits above. FIG. 5 is a block diagram schematically illustrating the structure of an initialization unit in some exemplary embodiments. The initialization unit 5 shown in FIG. 5 includes a first initialization transistor T6, having a first electrode coupled to the external initialization voltage Vin, and a second initialization transistor T7. The first initialization transistor T6 has a second electrode electrically coupled to the first node N1 and a gate electrode configured to receive the second scanning signal Sn−1. The second initialization transistor T7 has a first electrode configured to receive the external initialization voltage Vin, a second electrode electrically coupled to the light emitting unit EL4 and a gate electrode configured to receive the third scanning signal Sn−2. While the first initialization transistor is on in response to the second scanning signal Sn−1, the initialization voltage Vin, with which the first node N1 is initialized, is transmitted to the first node N1 via the first initialization transistor T6. While the second initialization transistor T7 is on in response to the third scanning signal Sn−2, the initialization voltage Vin, with which the light emitting unit EL4 is initialized, is transmitted to the light emitting unit EL4 via the second initialization transistor T7.

Figure 6:
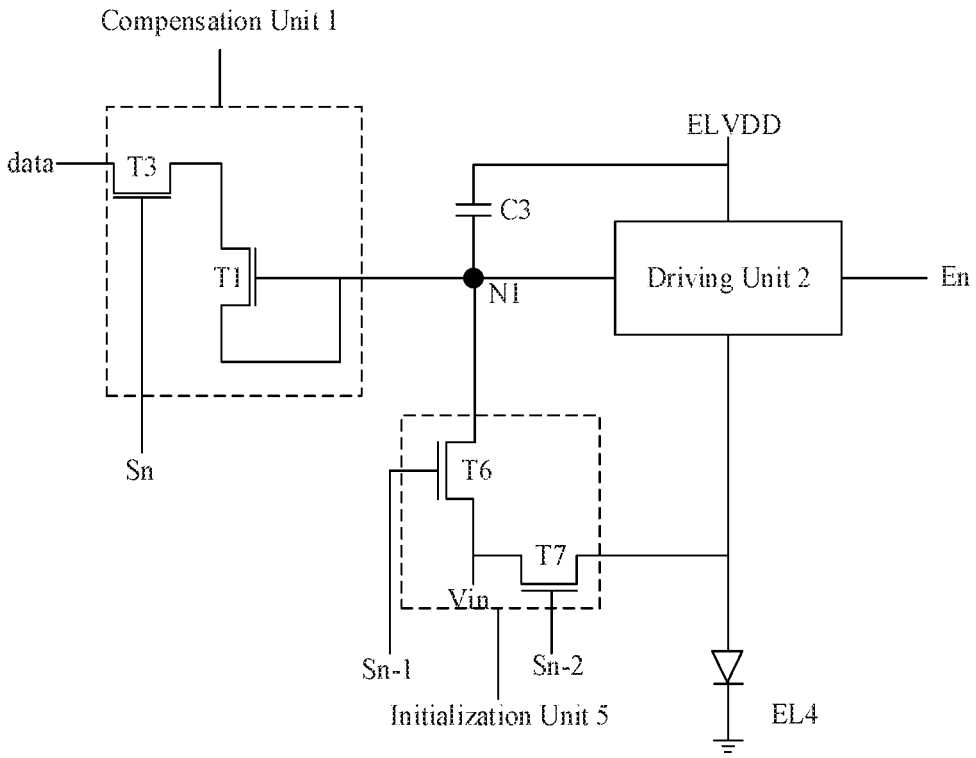
FIG. 6 is a block diagram schematically illustrating the structure of a compensation unit in some exemplary embodiments.

Optionally, some exemplary embodiments of present disclosure provide the implementation of a compensation unit. Referring to FIG. 6, which is a block diagram schematically illustrating the structure of a compensation unit in some exemplary embodiments, a compensation unit 1 of a pixel circuit includes a data strobe transistor T3 and a compensation transistor T1. The data strobe transistor T3 has a first electrode electrically coupled to a second electrode of the compensation transistor T1, a second electrode configured to receive the data signal data and a gate electrode configured to receive the first scanning signal Sn. The compensation transistor T1 has a first electrode electrically coupled to a gate electrode of the compensation transistor T1 and a gate electrode electrically coupled to the driving unit 2 via the first node N1. The compensation unit 1 is configured to turn the data strobe transistor T3 on in response to the first scanning signal Sn, thus the compensation transistor T1 sets a voltage on the first node N1 as a first voltage, ($V_{data}$+$V_{thT1}$).

Figure 7:
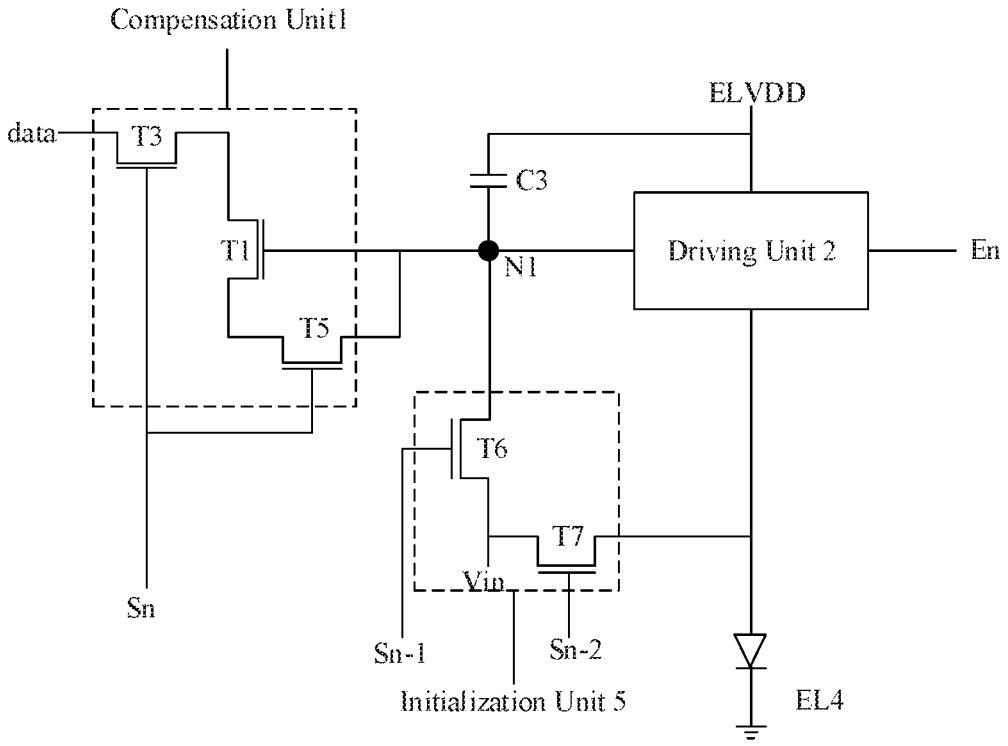
FIG. 7 is a block diagram schematically illustrating the structure of another compensation unit in some exemplary embodiments.

Optionally, the compensation unit may further include at least one switch transistor for the purpose of enhancing the isolation of the data signal of the pixel circuit from the external power supply. Referring to FIG. 7, which is a block diagram schematically illustrating the structure of another compensation unit in some exemplary embodiments, a switch transistor T5 has a first electrode electrically coupled to the gate electrode of the compensation transistor T1, a second electrode electrically coupled to the first electrode of the compensation transistor T1 and a gate electrode configured to receive the first scanning signal Sn. When the switch transistor T5 conducts in response to the first scanning signal Sn, the drain and gate electrodes of the compensation transistor T1 conduct, such that the compensation transistor T1 starts to write data to the first node N1, on which the voltage is set to the first voltage.

Figure 8:
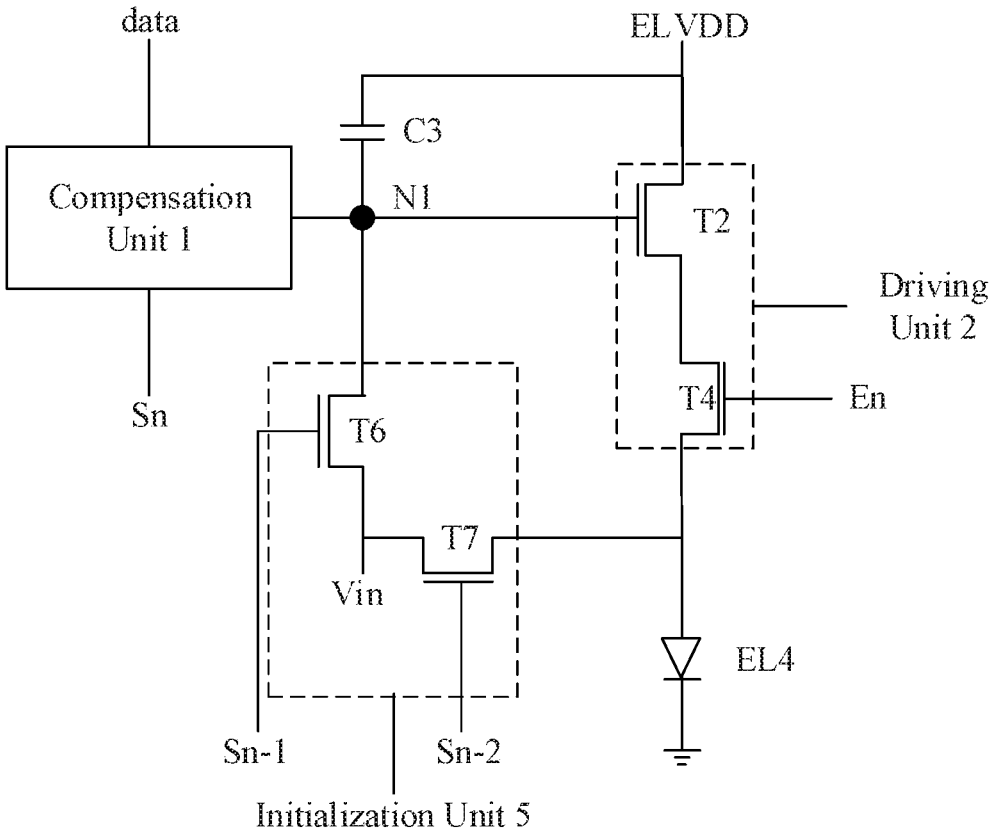
FIG. 8 is a block diagram schematically illustrating the structure of a driving unit in some exemplary embodiments.

Optionally, some exemplary embodiments of present disclosure provide the implementation of a driving unit. Referring to FIG. 8 which is a block diagram schematically illustrating the structure of a driving unit in some exemplary embodiments, a driving unit 2 includes a driving transistor T2 and a light emitting control transistor T4. The driving transistor T2 has a first electrode figured to receive an external first power supply ELVDD, a gate electrode electrically coupled to the compensation unit 1 and a second electrode electrically coupled to a first electrode of the light emitting control transistor T4, wherein the light emitting control transistor T4 has a second electrode electrically coupled to the light emitting unit EL4. A gate electrode of the light emitting unit EL4 is configured to receive the external first control signal En. When the light emitting control transistor T4 conducts in response to En, the driving transistor T2 generates a driving current, which is received by the light emitting unit EL4 to emit light through the light control transistor T4, in the voltage on the gate electrode of the driving transistor T2 and the external power supply ELVDD.

In summary, some exemplary embodiments of present disclosure provide the implementation of a pixel circuit, comprising a compensation unit, a driving unit, a light emitting unit, a capacitor, an initialization unit and an external power supply, wherein the compensation unit is electrically coupled to the driving unit via a first node; wherein the external power supply, the driving unit and the light emitting unit are sequentially coupled in series; wherein the capacitor is disposed between the first node and the external power supply; wherein the initialization unit is disposed between the first node and the light emitting unit; wherein the compensation unit is configured to receive an external data signal and an external first scanning signal; wherein the compensation unit is configured to set a voltage on the first node to a first voltage in response to the first scanning signal; wherein the first voltage includes a voltage having a compensation voltage, generated by a compensation transistor in the compensation unit, and the voltage of the data signal; wherein the capacitor is configured to hold the voltage on the first node at the first voltage; wherein the driving unit is configured to receive an external first control signal; wherein the driving unit is configured to generate a driving current, in response to the first control signal, to drive the light emitting unit to emit light; wherein the driving current is generated in response to the first voltage, the external power supply and a threshold voltage of a driving transistor of the driving unit; wherein a gate electrode of the driving transistor is coupled to a gate electrode of the compensation transistor; wherein the initialization unit is configured to receive an external second scanning signal, an external third scanning signal and an external initialization voltage; wherein the initialization unit is configured to initialize the first node, in response to the second scanning signal, with the initialization voltage and to initialize the light emitting unit, in response to the third scanning signal, with the initialization voltage. The compensation unit receives an external data signal and the driving unit is coupled to an external power supply, such that the data signal can be compensated in a data writing stage by the compensation transistor of the compensation unit, wherein a first voltage includes a voltage having a compensation voltage, generated by the compensation transistor in the compensation unit, and the voltage of the data signal. The adverse effect of the external power supply, to which the compensation unit is not coupled, to the data signal can be avoided. Furthermore, the voltage on the gate electrode of the driving transistor is equal to that on the gate electrode of the compensation transistor with the gate electrodes coupled to each other, and compensating the voltage of the data signal with the threshold voltage of the compensation transistor is comparable to compensating the voltage of the data signal with the threshold voltage of the driving transistor, such that the threshold compensation of the pixel circuit is ensured. Therefore, some embodiments of present disclosure may both provide threshold compensation of the pixel circuit and avoid the external power supply from adversely affecting the data signal and the stability of the light emitting of the LED. What's more, with the initialization unit initializing the first node with the initialization voltage in response to the third scanning signal, it can be avoided that the first node and the light emitting unit are initialized at the same time, causing an instantaneous current, in response to the initialization voltage, which is sufficient to damage the pixel circuit, or its power supply, can be prevented, improving the safety of the pixel circuit.

Figure 9:
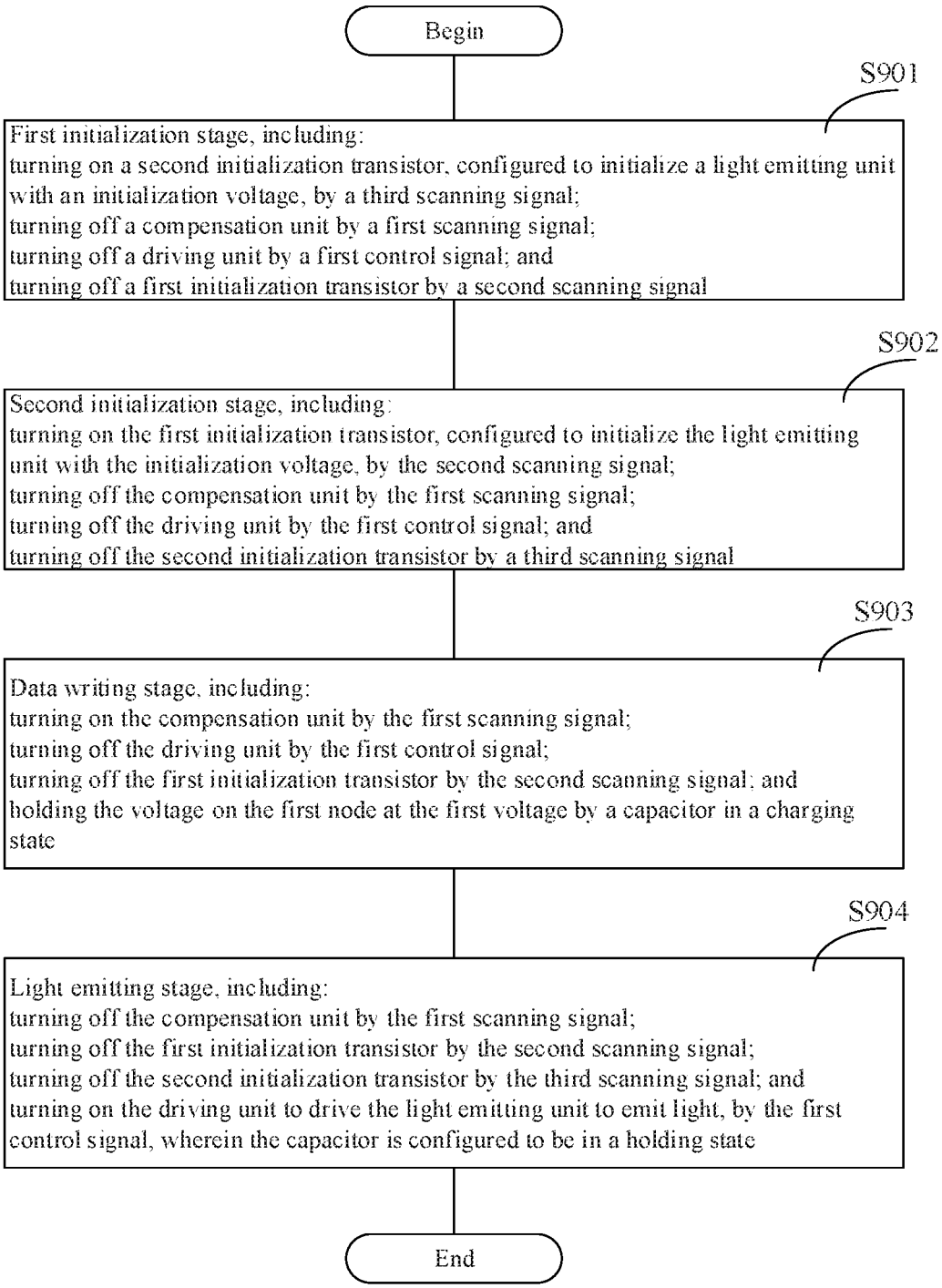
FIG. 9 is a flow chart illustrating a method for driving a pixel circuit in some exemplary embodiments.

An exemplary embodiment of present disclosure provides a method for driving a pixel circuit disclosed in some exemplary embodiments. According to FIG. 9, which is a flow chart, the method comprises the steps below:

S901, a first initialization stage, including:

turning on a second initialization transistor, configured to initialize a light emitting unit with an initialization voltage, by a third scanning signal;

turning off a compensation unit by a first scanning signal;

turning off a driving unit by a first control signal; and turning off a first initialization transistor by a second scanning signal;

S902, a second initialization stage, including:

turning on the first initialization transistor, configured to initialize the light emitting unit with the initialization voltage, by the second scanning signal;

turning off the compensation unit by the first scanning signal;

turning off the driving unit by the first control signal; and turning off the second initialization transistor by a third scanning signal;

S903, a data writing stage, including:

turning on the compensation unit, configured to set a voltage on a first node at a first voltage, by the first scanning signal;

turning off the driving unit by the first control signal such that the light emitting unit does not emit light;

turning off the first initialization transistor by the second scanning signal; and holding the voltage on the first node at the first voltage by a capacitor in a charging state, wherein the first voltage includes a voltage having a compensation voltage, generated by a compensation transistor in a compensation unit, and the voltage of the data signal;

and S904, a light emitting stage, including:

turning off the compensation unit by the first scanning signal;

turning off the first initialization transistor by the second scanning signal;

turning off the second initialization transistor by the third scanning signal; and turning on the driving unit, configured to generate a driving current which corresponds to the first voltage, an external power supply and a threshold voltage of a driving transistor in the driving unit, to drive the light emitting unit to emit light, by the first control signal, wherein the capacitor is configured to be in a holding state.

The method above may be applied to drive a pixel circuit shown in FIG. 3. It should be noticed that the step S901, whether before or after the step S903, should be before the step S904. In other words, the light emitting unit can be initialized before or after the data writing stage, so long as the initialization for the light emitting unit is accomplished before the light emitting stage. Similarly, the step S902, whether before or after the step S901, should be before the step S903, which means the initialization for the first node N1 is accomplished before the data writing stage.

During the first initialization sage, the compensation unit 1 is turned off in response to the first scanning signal Sn, with the first initialization transistor T6 turned off in response to the second scanning signal Sn−1, the driving unit 2 turned off in response to the first control signal En and the second initialization transistor T7 turned on in response to the third scanning signal Sn−2. The light emitting unit EL4 is initialized by the second initialization transistor T7 with the initialization voltage Vin. It should be noticed that the first initialization stage is included by the data writing stage when the first scanning signal Sn is used as the third scanning signal.

During the second initialization stage, the compensation unit 1 is turned off in response to the first scanning signal Sn, with the first initialization transistor T6 turned on in response to the second scanning signal Sn−1, the driving unit 2 turned off in response to the first control signal and the second initialization transistor T7 turned off in response to the third scanning signal Sn−2. The first node N1 is initialized by the first initialization transistor with the initialization voltage Vin.

During the data writing stage, the compensation unit 1 is turned on in response to the first scanning signal Sn, with the first initialization transistor T6 turned off in response to the second scanning signal Sn−1, the driving unit 2 turned off in response to the first control signal and the second initialization transistor T7 turned off in response to the third scanning signal Sn−2. The compensation unit 1 writes the data signal data to the first node N1, and the capacitor C3 is charged until the voltage on the first node N1 is set to the first voltage, $(V_{data}+V_{thT1})$. The compensation transistor is turned off thereafter while the voltage on the first node N1 stays at the first voltage, $(V_{data}+V_{thT1})$.

During the light emitting stage, the compensation unit 1 is turned off in response to the first scanning signal Sn, with the first initialization transistor T6 turned off in response to the second scanning signal Sn−1, the driving unit 2 turned off in response to the first control signal and the second initialization transistor T7 turned off in response to the third scanning signal Sn−2. The light emitting unit EL4 is driven to emit light by a driving current generated by the driving unit 2. In order to eliminate the adverse effect of a threshold drift of the driving transistor to the driving current, a compensation for the voltage on the gate electrode of the driving transistor of the driving unit can be provided, since the voltage on the first node is the first voltage, $(V_{data}+V_{thT1})$.

Some embodiments of present disclosure provide a further optimized threshold compensation circuit which can avoid adverse effects of the external power supply to the data signal and stabilize the light emission of LEDs, considering the light emission of LEDs unstable and the safety of circuits insufficient in existing technology. Some implementations based on PMOSes are discussed below. It should be noticed that different arrangements of elements or components of the implementations can be present, and many variations are possible without departing from the scope defined in the claims. It is not intended that each rearranged pixel circuit is discussed in detail, and only a few pixel circuits are described to illustrate the present disclosure.

(First Embodiment)

Figure 10:
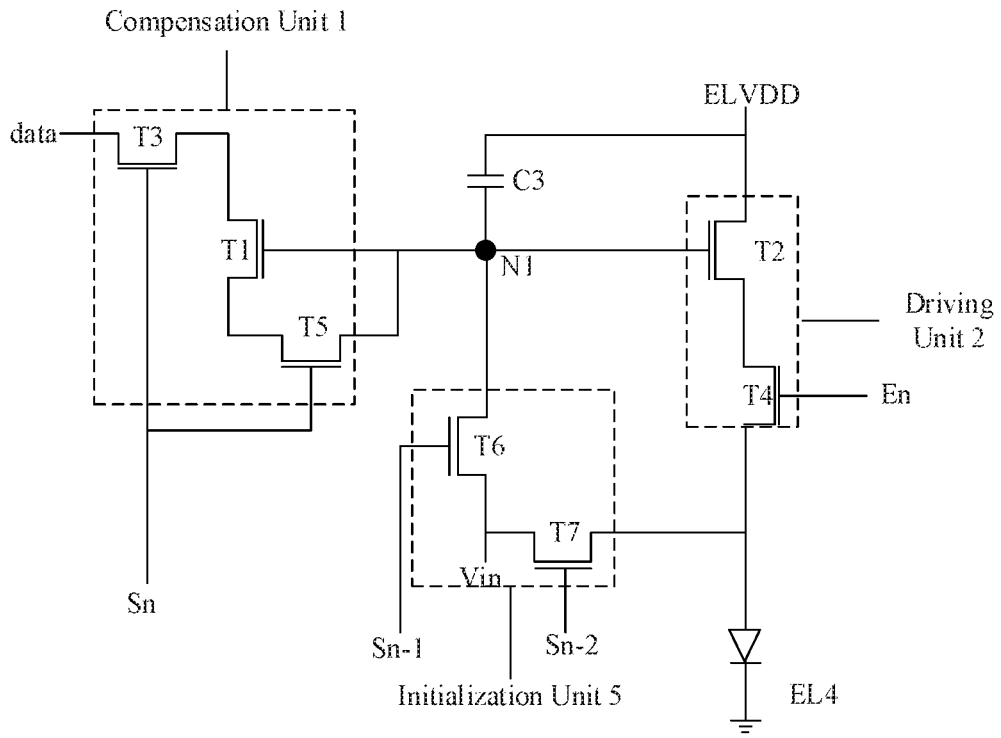
FIG. 10 is a schematic diagram of a pixel circuit in some exemplary embodiments.

Referring to FIG. 10, in one embodiment, the compensation unit 1 includes a data strobe transistor T3, a compensation transistor T1 and a switch transistor T5. The driving unit 2 includes a driving transistor T2 and a light emitting control transistor T4, while the initialization unit 5 includes a first initialization transistor T6 and a second initialization transistor T7.

Within the compensation unit 1, the data strobe transistor T3 has a drain electrode electrically coupled to the source electrode of the compensation transistor T1, a source electrode configured to receive the data signal data and a gate electrode configured to receive the first scanning signal Sn. The compensation transistor T1 has a gate electrode electrically coupled to a gate electrode of the driving transistor T2 via the first node N1 and a drain electrode electrically coupled to a source electrode of the switch transistor T5, wherein the switch transistor T5 has a drain electrode electrically coupled to a gate electrode of the compensation transistor T1 and a gate electrode configured to receive the first scanning signal Sn.

Within the driving unit 2, the driving transistor T2 has a source electrode configured to receive the external power supply ELVDD and a drain electrode electrically coupled to a source electrode of the light emitting control transistor T4 which has a drain electrode electrically coupled to the light emitting unit EL4 and a gate electrode configured to receive the external first control signal En.

Within the initialization unit 5, the first initialization transistor T6 has a source electrode configured to receive the external initialization voltage Vin, a drain electrode electrically coupled to the first node N1 and a gate electrode configured to receive the second scanning signal Sn−1. The second initialization transistor T7 has a source electrode configured to receive the external initialization voltage Vin, a drain electrode electrically coupled to the light emitting unit EL4 and a gate electrode configured to receive the third scanning signal Sn−2.

Figure 11:
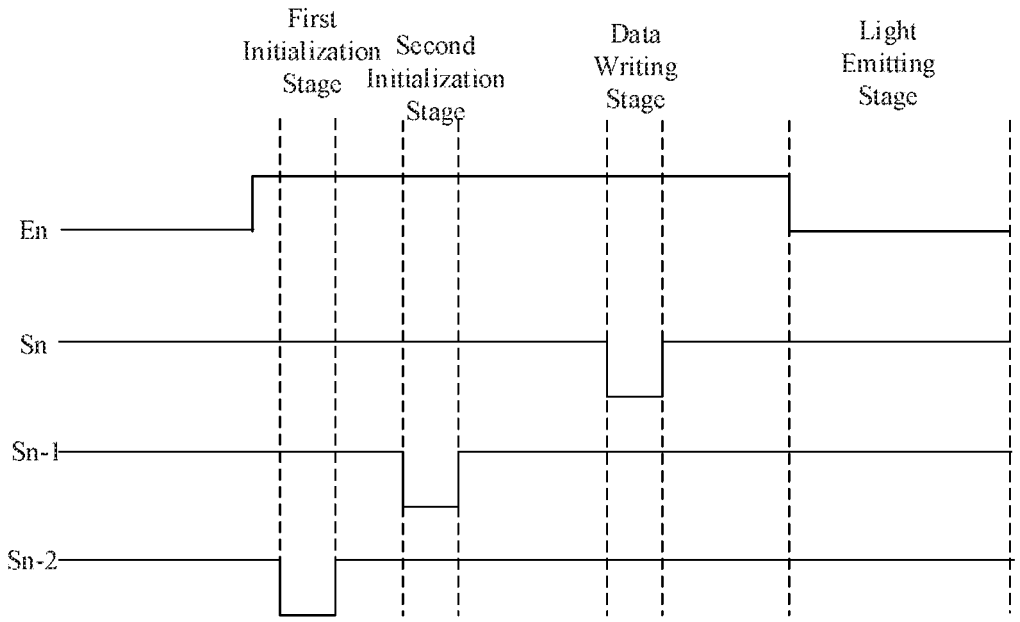
FIG. 11 is a sequence chart illustrating signals for driving the pixel circuit shown in FIG. 10.

Correspondingly, FIG. 11 illustrates the waveform of the driving signal for driving the pixel circuit, shown in FIG. 10, in some embodiments. The driving signal, which can be divided into a first initialization stage, a second initialization stage, a data writing stage and a light emitting stage in time, includes the first scanning signal Sn, the second scanning signal Sn−1, the third scanning signal Sn−2 and the first control signal En.

During the first initialization stage, with the voltage level of the first scanning signal Sn being high, the data strobe transistor T3, the switch transistor T5 and the compensation unit 1 are turned off. The voltage level of second scanning signal Sn−1 is high, and the first initialization transistor T6 is turned off. The voltage level of the first control signal En is high, and the light emitting control transistor T4 and the driving unit 2 are turned off. The voltage level of the third scanning signal Sn−2 is low, and the second initialization transistor T7, conducting, initializes the light emitting unit EL4 with the initialization voltage Vin.

During the second initialization stage, the voltage level of the first scanning signal Sn is high, and the data strobe transistor T3, the switch transistor T5 and the compensation unit 1 are turned off. The voltage level of the second scanning signal Sn−1 is low, and the first initialization transistor T6 conducts. The voltage level of the first control signal En is high, and the light emitting control transistor T4 and the driving unit 2 are turned off. The voltage level of the third scanning signal Sn−2 is high and the second initialization transistor T7 is turned off. The first node N1 is initialized by the first initialization transistor with the initialization voltage Vin.

During the data writing stage, with the voltage level of the first scanning signal Sn being low, the data strobe transistor T3 and the switch transistor T5 conduct and the compensation unit 1 is turned on. The voltage level of the second scanning signal Sn−1 is high and the first initialization transistor T6 is turned off. The voltage level of first control signal En is high, and the light emitting control transistor T4 and the driving unit 2 are turned off. The voltage level of the third scanning signal Sn−2 is high and the second initialization transistor T7 is turned off. The data signal data is written to the first node N1 by the compensation transistor T1, with the capacitor C3 being charged until the voltage on the first node N1 is set to the first voltage, $(V_{data}+V_{thT1})$. The compensation transistor T1 is turned off thereafter, with the capacitor C3 holding the voltage on the first node N1 at the first voltage, $(V_{data}+V_{thT1})$.

During the light emitting stage, with the voltage level of the first scanning signal Sn being high, the data strobe transistor T3, the switch transistor T5 and the compensation unit 1 are turned off. The voltage level of the second scanning signal Sn−1 is high and the first initialization transistor T6 is turned off. The voltage level of the first control signal En is low, and the light emitting control transistor T4 and the driving unit 2 are turned on. The voltage level of third scanning signal Sn−2 is high and the second initialization transistor T7 is turned off. The voltage on the gate electrode of the driving transistor of the driving unit 2 can be compensated by the voltage, being the first voltage, which is $(V_{data}+V_{thT1})$, on the first node, which prevents the driving current from adverse effects of the threshold drift of the driving transistor.

(Second Embodiment)

Figure 12:
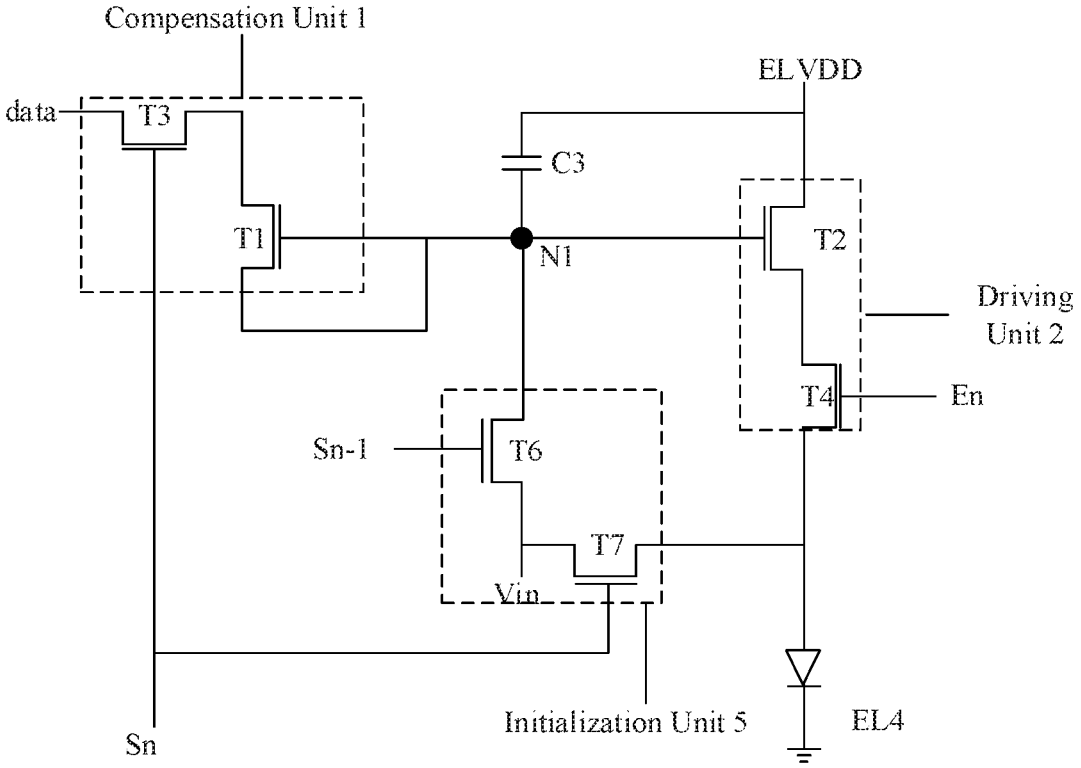
FIG. 12 is a schematic diagram of a pixel circuit in some exemplary embodiments.

Referring to FIG. 12, in one embodiment, the compensation unit 1 includes a data strobe transistor T3 and a compensation transistor T1, wherein the driving unit 2 includes a driving transistor T2 and a light emitting control transistor T4 and the initialization unit 5 includes a first initialization transistor T6 and a second initialization transistor T7.

Within the compensation unit 1, the data strobe transistor T3 has a drain electrode electrically coupled to a source electrode of the compensation transistor T1, a source electrode configured to receive the data signal data and a gate electrode configured to receive the first scanning signal Sn. The compensation transistor T1 has a gate electrode electrically coupled to a gate electrode of the driving transistor T2 via the first node N1 and a drain electrode electrically coupled to a gate electrode of the compensation transistor T1.

Within the driving unit 2, the driving transistor T2 has a source electrode configured to receive the external power supply ELVDD and a drain electrode electrically coupled to a source electrode of the light emitting control transistor T4 which has a drain electrode electrically coupled to the light emitting unit EL4 and a gate electrode configured to receive the external first control signal En.

Within the initialization unit 5, the first initialization transistor T6 has a source electrode configured to receive the external initialization voltage Vin, a drain electrode electrically coupled to the first node N1 and a gate electrode configured to receive the second scanning signal Sn−1. The second initialization transistor T7 has a source electrode configured to receive the external initialization voltage Vin, a drain electrode electrically coupled to the light emitting unit EL4 and a gate electrode configured to receive the first scanning signal Sn.

Figure 13:
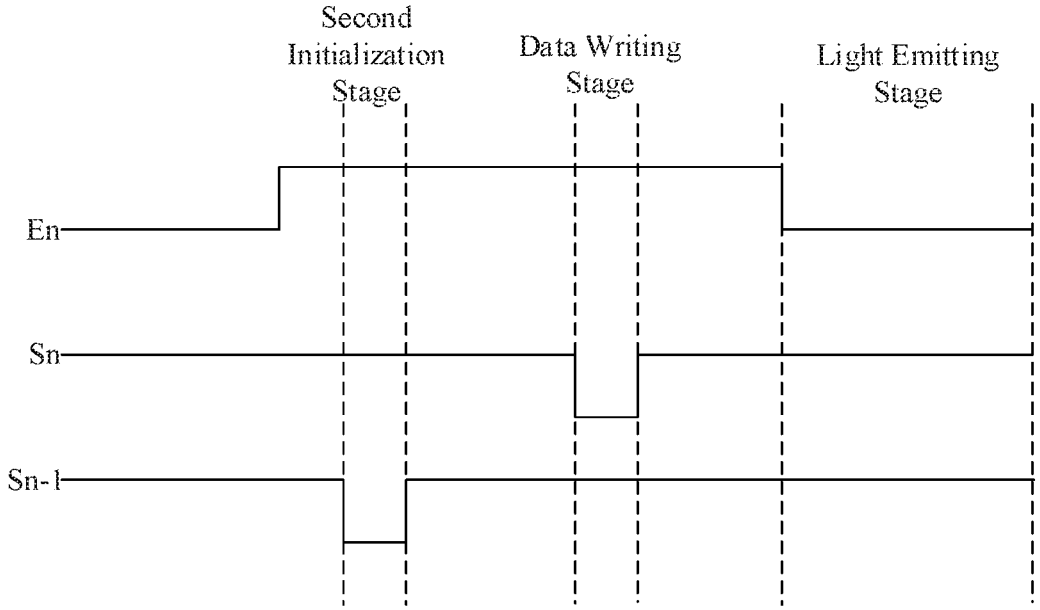
FIG. 13 is a sequence chart illustrating signals for driving the pixel circuit shown in FIG. 12.

Correspondingly, FIG. 13 illustrates the waveform of the driving signal for driving the pixel circuit, shown in FIG. 12, in some embodiments. The driving signal, which can be divided into a first initialization stage, a second initialization stage, a data writing stage and a light emitting stage in time, includes the first scanning signal Sn, a second scanning signal Sn−1 and a first control signal En.

During the second initialization stage, with the voltage level of the first scanning signal Sn being high, the data strobe transistor T3, the compensation unit 1 and the second initialization transistor T7 are turned off. The voltage level of the second scanning signal Sn−1 is low and the first initialization transistor T6 conducts. The voltage level of the first control signal En is high, and the light emitting control transistor T4 and the driving unit 2 are turned off. The first node N1 is initialized by the first initialization transistor with the initialization voltage Vin.

During the data writing stage, with the voltage level of the first scanning signal Sn being low, the data strobe transistor T3, the switch transistor T5, the compensation unit 1 and the second initialization transistor T7 are turned on. The voltage level of the second scanning signal Sn−1 is high and the first initialization transistor T6 is turned off. The voltage level of the first control signal En is high, and the light emitting control transistor T4 and the driving unit 2 are turned off. The voltage level of the third scanning signal Sn−2 is high and the second initialization transistor T7 is off. The data signal data is written to the first node N1 by the compensation transistor T1, while the capacitor C3 is charged until the voltage on the first node N1 is set to the first voltage, $(V_{data}+V_{thT1})$. The compensation transistor T1 is turned off thereafter, with the capacitor C3 holding the voltage on the first node N1 at the first voltage, $(V_{data}+V_{thT1})$. The light emitting unit EL4 is initialized by the second initialization transistor T7 with the initialization voltage Vin at the meantime.

During the light emitting stage, with the voltage level of the first scanning signal Sn being high, the data strobe transistor T3, the switch transistor T5, the compensation unit 1 and the second initialization transistor T7 are off. The voltage level of the second scanning signal Sn−1 is high and the first initialization transistor T6 is off. The voltage level of the first control signal En is low, and the light emitting control transistor T4 and the driving unit 2 are turned on. The voltage on the gate electrode of the driving transistor of the driving unit 2 can be compensated by the voltage, being the first voltage, which is $(V_{data}+V_{thT1})$, on the first node, which prevents the driving current from adverse effects of the threshold drift of the driving transistor.

Figure 14:
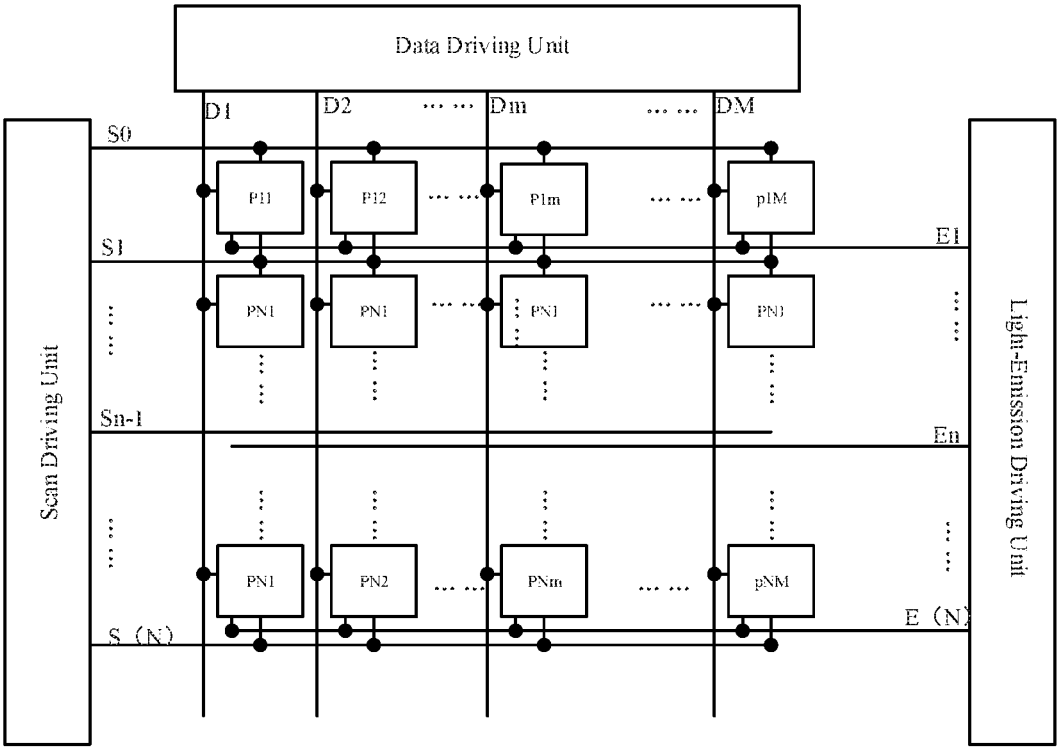
FIG. 14 is a block diagram illustrating a display device in some exemplary embodiments.

In one embodiment of present disclosure, a display device, having a pixel circuit disclosed in any embodiment above, is provided. Referring to FIG. 14 which is a block diagram illustrating a display device, in one embodiment, the display device includes an N×M array of pixel circuits. A scan driving unit generates scanning signals S0, S1, S2, . . . , SN wherein an Sn refers to a scanning signal, from the scan driving unit, for pixels in the n-th line, n=1, 2, . . . , N. Data signals data, including D1, D2 . . . . , DM, the total number of which is M, is generated by a data driving unit, wherein a Dm refers to a data signal data for pixels in the n-th row, m=1, 2, . . . . M. Also, first control signals E1, E2, . . . , EN are generated by a light emitting driving unit, wherein an En refers to a first control signal, from the light emitting control unit, for pixels in the n-th line, n=1, 2, . . . , N.

In summary, some embodiments of present disclosure provide a pixel circuit, a driving method for the pixel circuit and a display device. The pixel circuit comprises a compensation unit, a driving unit, a light emitting unit, a capacitor, an initialization unit and an external power supply, wherein the compensation unit is electrically coupled to the driving unit via a first node; wherein the external power supply, the driving unit and the light emitting unit are sequentially coupled in series; wherein the capacitor is disposed between the first node and the external power supply; wherein the initialization unit is disposed between the first node and the light emitting unit; wherein the compensation unit is configured to receive an external data signal and an external first scanning signal; wherein the compensation unit is configured to set a voltage on the first node to a first voltage in response to the first scanning signal; wherein the first voltage includes a voltage having a compensation voltage, generated by a compensation transistor in the compensation unit, and the voltage of the data signal; wherein the capacitor is configured to hold the voltage on the first node at the first voltage; wherein the driving unit is configured to receive an external first control signal; wherein the driving unit is configured to generate a driving current, in response to the first control signal, to drive the light emitting unit to emit light; wherein the driving current is generated in response to the first voltage, the external power supply and a threshold voltage of a driving transistor of the driving unit, wherein a gate electrode of the driving transistor is coupled to a gate electrode of the compensation transistor; wherein the initialization unit is configured to receive an external second scanning signal, an external third scanning signal and an external initialization voltage, wherein the initialization unit is configured to initialize the first node, in response to the second scanning signal, with the initialization voltage and to initialize the light emitting unit, in response to the third scanning signal, with the initialization voltage. Since the compensation is configured to receive the external data and the driving unit is configured to receive an external power supply, during the data writing stage, the data signal is compensated by the compensation transistor of the compensation unit, and a first voltage having a threshold voltage of the compensation transistor compensated to the voltage of the data signal can be available. With the compensation unit not coupled to the external power supply, adverse effects of the external power supply on the data signal can be avoided. Furthermore, the voltage on the gate electrode of the driving transistor is equal to that on the gate electrode of the compensation transistor since the two electrodes are electrically coupled, thus a threshold voltage of the compensation transistor compensated to the voltage of the data signal is equal to a threshold voltage of the driving transistor compensated to the voltage of the data signal, ensuring the threshold compensation of the pixel circuit. Hence, embodiments of present disclosure can not only achieve the threshold compensation for a pixel circuit but also avoid adverse effects of the external power supply on the data signal and stabilize the light emission of an LED. Moreover, the initialization unit initializes the first node with the initialization voltage in response to the second scanning signal and initializes the light emitting unit with the initialization voltage in response to the third scanning signal, which enables the initialization unit to initialize the first node and the light emitting unit during different periods of time respectively. An instantaneous current, in response to the initialization voltage, which is sufficient to damage the pixel circuit or its power supply can be prevented, improving the safety of the pixel circuit, since the first node and the light emitting unit are not initialized at the same time.

Those skilled in the art will readily appreciate that the detailed description given herein with respect to these figures is for explanatory purposes only and should not be construed as limiting.

What is claimed is:

1. A pixel circuit, comprising:

a compensation circuit configured to receive an external data signal and an external first scanning signal, and set a voltage on a first node to a first voltage in response to the first scanning signal, wherein the first voltage includes a compensation voltage generated by a compensation transistor in the compensation circuit and a voltage of the data signal;

a driving circuit including a driving transistor, wherein a gate electrode of the driving transistor is electrically coupled to a gate electrode of the compensation transistor via the first node;

a light emitting diode, wherein an external power supply, the driving circuit and the light emitting diode are sequentially coupled in series, the driving circuit is configured to receive an external first control signal and generate a driving current in response to the first control signal to drive the light emitting diode to emit light, the driving current is generated in response to the first voltage, the external power supply and a threshold voltage of the driving transistor;

a capacitor disposed between the first node and the external power supply, and configured to hold the voltage on the first node at the first voltage; and an initialization circuit disposed between the first node and the light emitting diode, the initialization circuit comprises a first initialization transistor and a second initialization transistor, wherein the first initialization transistor has a first electrode configured to receive an external initialization voltage, a second electrode electrically coupled to the first node, and a gate electrode configured to receive an external second scanning signal, and the second initialization transistor has a first electrode configured to receive the initialization voltage, a second electrode electrically coupled to the light emitting diode, and a gate electrode configured to receive an external third scanning signal; and the first initialization transistor is configured to initialize the first node, in response to the second scanning signal at a second time, with the initialization voltage, and the second initialization transistor is configured to initialize the light emitting diode, in response to the third scanning signal at a first time, with the initialization voltage; wherein the first time precedes the second time.

2. The pixel circuit according to claim 1, wherein the threshold voltage of the driving transistor is equal to a threshold voltage of the compensation transistor.

3. The pixel circuit according to claim 1, wherein the third scanning signal includes the first scanning signal.

4. The pixel circuit according to claim 1, wherein the compensation circuit comprises:

a data strobe transistor having a first electrode electrically coupled to a second electrode of the compensation transistor, a second electrode configured to receive the external data signal, and a gate electrode configured to receive the external first scanning signal;

wherein the gate electrode of the compensation transistor is electrically coupled to a first electrode of the compensation transistor;

wherein the compensation circuit is configured to turn on the data strobe transistor in response to the first scanning signal, and the compensation transistor then set the voltage of the first node at the first voltage.

5. The pixel circuit according to claim 4, wherein the compensation circuit further comprising:

a switch transistor having a first electrode electrically coupled to the gate electrode of the compensation transistor, a second electrode electrically coupled to the first electrode of the compensation transistor, and a gate electrode configured to receive the external first scanning signal and the switch transistor is configured to turn on or turn off the compensation transistor in response to the first scanning signal.

6. A method for driving a pixel circuit, steps of the method comprising:

a first initialization stage including: turning on a second initialization transistor to initialize a light emitting diode with an initialization voltage, by a third scanning signal; turning off a compensation circuit by a first scanning signal; turning off a driving circuit by a first control signal; and turning off a first initialization transistor by a second scanning signal;

a second initialization stage after the first initialization stage, including: turning on the first initialization transistor to initialize a first node with the initialization voltage, by the second scanning signal; turning off the compensation circuit by the first scanning signal; turning off the driving circuit by the first control signal; and turning off the second initialization transistor by the third scanning signal;

a data writing stage, after the second initialization stage, including: turning on the compensation circuit to set a voltage on the firs(node at a first voltage, by the first scanning signal; turning off the driving circuit by the first control signal such that the light emitting diode does not emit light; turning off the first initialization transistor by the second scanning signal; and holding the voltage on the first node at the first voltage by a capacitor in a charging state, wherein the first voltage includes a compensation voltage generated by a compensation transistor in the compensation circuit and a voltage of the data signal; and a light emitting stage, after the first initialization stage, including: turning off the compensation circuit by the first scanning signal; turning off the first initialization transistor by the second scanning signal; turning off the second initialization transistor by the third scanning signal; and turning on the driving circuit to generate a driving current Which corresponds to the first voltage, an external power supply and a threshold voltage of a driving transistor in the driving circuit, to drive the light emitting diode to emit light, by the first control signal, wherein the capacitor is in a holding state.

7. The method according to claim 6, wherein the third scanning signal incorporates the first scanning signal and the first initialization stage is incorporated in the data writing stage.

8. The method according to claim 6, wherein the step of turning on the compensation circuit by the first scanning signal comprises:

turning on a data strobe transistor by the first scanning signal.

9. The method according to claim 6, wherein the step of turning on the compensation circuit by the first scanning signal comprises:

turning on a switch transistor by the first scanning signal.

10. A display device, comprising a pixel circuit, wherein the pixel circuit includes:

a compensation circuit configured to receive an external data signal and an external first scanning signal, and set a voltage on a first node to a first voltage in response to the first scanning signal, wherein the first voltage includes a compensation voltage generated by a compensation transistor in the compensation circuit and a voltage of the data signal;

a driving circuit including a driving transistor, wherein a gate electrode of the driving transistor is electrically coupled to a gate electrode of the compensation transistor via the first node;

a light emitting diode, wherein an external power supply, the driving circuit and the light emitting diode are sequentially coupled in series, the driving circuit is configured to receive an external first control signal and generate a driving current in response to the first control signal to drive the light emitting diode to emit light, the driving current is generated in response to the first voltage, the external power supply and a threshold voltage of the driving transistor;

a capacitor disposed between the first node and the external power supply, and configured to hold the voltage, on the first node at the first voltage: and an initialization circuit disposed between the first node and the light emitting diode, the initialization circuit comprises a first initialization transistor and a second initialization transistor, wherein the first initialization transistor has a first electrode configured to receive an external initialization voltage, a second electrode electrically coupled to the first node, and a gate electrode configured to receive an external second scanning signal, and the second initialization transistor has a first electrode configured to receive the initialization voltage, a second electrode electrically coupled to the light emitting diode, and a gate electrode configured to receive an external third scanning signal; and the first initialization transistor is configured to initialize the first node, in response to the second scanning signal at a second tine, with the initialization voltage, and the second initialization transistor is configured to initialize the light emitting diode, in response to the third scanning signal at a first time, with the initialization voltage, wherein the first time precedes the second time.

11. The display device according to claim 10, wherein the threshold voltage of the driving transistor is equal to a threshold voltage of the compensation transistor.

12. The display device according to claim 10, wherein the third scanning signal includes the first scanning signal.

13. The display device according to claim 10, wherein the compensation circuit comprises:

a data strobe transistor having a first electrode electrically coupled to a second electrode of the compensation transistor, a second electrode configured to receive the external data signal, and a gate electrode configured to receive the external first scanning signal;

wherein the gate electrode of the compensation transistor is electrically coupled to a first electrode of the compensation transistor;

wherein the compensation circuit is configured to turn on the data strobe transistor in response to the first scanning signal, and the compensation transistor then set the voltage of the first node at the first voltage.

14. The display device according to claim 13, wherein the compensation circuit further comprising:

a switch transistor having a first electrode electrically coupled to the gate electrode of the compensation transistor, a second electrode electrically coupled to the first electrode of the compensation transistor, and a gate electrode configured to receive the external first scanning signal, and the switch transistor configured to conduct the compensation transistor in response to the first scanning signal.

* * * * *